United States Patent [19]

Felburn

[11] 4,067,470

[45] Jan. 10, 1978

[54] SELF LOADING REFUSE VEHICLE WITH A DISCHARGE GATE IN THE LOADING MEANS

[76] Inventor: John Phil Felburn, P.O. Box 2344, Arlington, Va. 22202

[21] Appl. No.: 637,077

[22] Filed: Dec. 2, 1975

[51] Int. Cl.[2] ..... B65F 3/04; B65F 3/26

[52] U.S. Cl. ..... 214/503; 214/77 R; 214/78

[58] Field of Search ..... 214/501, 503, 78, 83.3, 214/300, 301, 302, 303, 77 R

[56] References Cited

U.S. PATENT DOCUMENTS

| | | | |
|---|---|---|---|
| 2,019,451 | 10/1935 | Harm | 214/77 R |
| 2,541,965 | 2/1951 | Hensley | 214/78 |
| 3,353,693 | 11/1967 | Zink | 214/78 |
| 3,446,377 | 5/1969 | Heinert | 214/77 R |

FOREIGN PATENT DOCUMENTS

| | | | |
|---|---|---|---|
| 1,559,484 | 4/1968 | France | 214/501 |
| 1,949,991 | 4/1971 | Germany | 214/78 |

*Primary Examiner*—Robert J. Spar
*Assistant Examiner*—Carl Rowold
*Attorney, Agent, or Firm*—Michael Williams

[57] ABSTRACT

The invention relates to vehicles which are particularly adapted for use in refuse collection, but may also have other uses, such as for self-loading of aggregates, or lifting and transportation of bulky objects.

The body of the vehicle comprises a plurality of sections, one adapted to receive the material to be collected and to in turn deliver it to another body section. To unload the vehicle body, the said other body section is moved to cooperative relation with the said one body section so that the material flows through and outwardly of the latter.

5 Claims, 17 Drawing Figures

16
27
21
36
34
38
36
37
55
57
35
34
36
26
32
57
55
31
38
35
36
37
30
55
57
33
32
55
57
37
56
56
53

SELF LOADING REFUSE VEHICLE WITH A DISCHARGE GATE IN THE LOADING MEANS

BACKGROUND AND SUMMARY

Refuse in the past has been collected in trucks of various constructions. Initially, such trucks were merely open bodies into which the refuse was thrown, but these had the disadvantages that the refuse was not covered and has a tendency to spill over the body sides. To avoid such spillage, the truck was loaded to only part of its capacity. A further disadvantage was the fact that a refuse collector would often-times encounter heavy refuse articles or containers and would find it difficult, without help, to deposit the same in the collection truck.

More recently, compactor-type trash trucks have been developed wherein the refuse collector would deposit the refuse on the back portion of the truck body and this refuse would be delivered to the main portion of the truck body and compacted therein. Such compactor trucks were large, cumbersome and expensive. Because garbage and trash is usually light and bulky, the compactor-type trucks in order to justify their cost, must compact the refuse sufficiently to create a heavy, dense mass before leaving for the landfill which is usually some distance from the city. The high compacting forces that are required necessitate the fabrication of a truck body of sufficient rigidty to withstand the compacting forces, and this results in expensive manufacturing costs. In addition, since the refuse is highly compacted, it is sometimes difficult to unload and further presents a problem in even distribution over the landill area. Also, the compactor-type trash truck has mechanism within the body area which becomes intermingled with the garbage and trash, therefore creating operating and maintenance difficulties, not prevalent in the construction herein disclosed.

My invention provides a low-cost unit which serves the refuse-collection problem economically and efficiently. In use of my invention, the refuse is not compacted but is delivered to one body section which when filled, is operated to in turn deliver the refuse to another body section. In one embodiment of my invention, the truck body comprises a large main body section and a smaller loader section at the rear of the main section. The loader section has an opening at a low level through which the refuse may be easily deposited. The body sections are relatively movable so that the loader section may be moved to deposit refuse into the main section and then return for further refuse, and this is continued until the main body section is filled to capacity, whereupon the truck is moved to the land-fill or other dumping area. The main body section is then moved relative to the loader section so that the refuse moves through the latter section and is dumped.

The loader section of the truck body has a tailgate which may be swung to one position wherein it permits dumping of the refuse. In another position of the tailgate, it acts as a platform upon which a large refuse receptable, such as is commonly used in commercial establishments, may be placed and connected for transport by the loader section to dump its contents into the main body section. Also, in the latter position of the tailgate, it may function as a scoop when the truck is backed into a pile of aggregates so that the truck becomes a self-loader vehicle.

In another form of my invention, the two body sections may be substantially equal in size and are disposed relative to each other and to the truck chassis so that refuse may be loaded or unloaded from either side of the truck.

DESCRIPTION OF THE DRAWINGS

In the drawings accompanying this specification and forming a part of this application, there are shown, for purposes of illustration, embodiments which my invention may assume, and in these drawings.

DESCRIPTION OF THE PREFERRED EMBODIMENT

Figure 1:
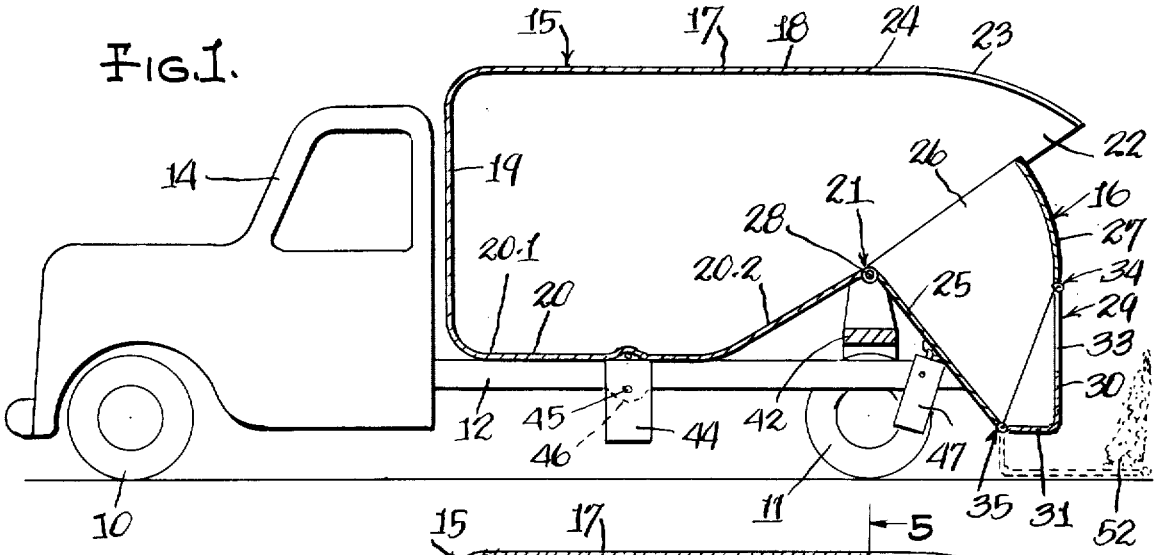
FIG. 1 is a side elevational view of a truck in somewhat schematic form, showing a preferred embodiment of a truck body in longitudinal section, with the body sections in position for loading refuse into the loader section, or for transportation to a dumping area.

The embodiment of my invention shown in FIGS. 1 through 12 may be used with a conventional truck chassis which includes front and rear sets of wheels 10 and 11 respectively, supported in usual manner from a truck frame which is formed in part by a pair of laterally spaced, longitudinally extending metal channels 12. An operator's cab 14 is supported at the front of the truck frame in normal manner.

The disclosed embodiment comprises a relatively large main body section 15 which provides large cubic storage area, and a smaller section 16. The main body section is provided with a top wall 17, spaced side walls 18—18, a front wall 19, and a bottom wall 20. In the illustrated embodiment, the bottom wall has a flat forward portion 20.1 and an upwardly extending rear portion 20.2 which inclines to a horizontally extending pivot point 21. The bottom wall may be formed otherwise than specifically shown; for example, the floor may be disposed entirely within a plane which inclines downwardly from the pivot point 21 to the juncture with the front wall 19. Preferably the bottom wall of the main body is adapted to be supported by the truck frame in the position shown in FIG. 1, as by resting directly on the upper flanges of the channels 12, or on support means (not shown) carried by the latter. The top wall 17 at the rear end of the main body section curves downwardly and provides a rear opening 22 extending to the pivot point 21. The top wall 17 has a longitudinal opening 23 at its rear to provide for clearance of parts, as will be shown in later description. If desired, the top wall may terminate at the point 24 and the part rearwardly of this point may be omitted.

The smaller loader section 16, in the position shown in FIG. 1, comprises a bottom wall 25 which inclines downwardly from the pivot point 21, side walls 26—26 and a rear wall 27 which is preferably curved and has the pivot point 21 as its center of curvature. The pivot point 21 is in the form of a structurally sufficient piano hinge, with portions of the bottom walls 20.2 and 25 of the body sections forming the hinge portions and a pintle pin 28 joining the same.

A tailgate 29 has angular disposed leg portions 30 and 31 and sidewings 32 (see especially FIGS. 6 through 9). The leg portion 30 has a large opening 33 through which refuse is tossed for deposit in the loader section 16. The tailgate 29 has a double hinge connection with the loader section, such connections being shown at 34 and 35. The connections are so constructed and arranged that a selected pair may be disengaged so that the tailgate may pivot about the other pair. Each hinge connection may take the form of a clevis 36 welded to the inside of a sidewall 26 of the loader section, and a stub axle 37 welded to the outside of the tailgate wings 32. Each axle fits within a respective clevis and is held therein for pivotal movements by a removable pin 38. When the pins are removed from a selected hinge connection, the tailgate may be rotated about the other hinge connection.

As seen in the various drawings, the sloping bottom walls 20.2 and 25 form a convenient well for the rear wheels 11 of the truck, and it will also be noted that the axis of the pintle pin 28 is directly above the axle of the rear wheels. The pintle pin 28 is supported in position above the rear wheel axle in any suitable manner, such as by side bearings 40 (see FIG. 5), which are carried by arms 41 secured to and extending upwardly from a cross-plate 42. The plate 42 is supported by spacer blocks 43 from respective channels 12 of the truck frame.

Suitable means are provided to selectively move the main body section 15 and the loader section 16 about the pivot formed by the pintle pin 28. In the embodiment shown in FIGS. 1 through 12, two fluid cylinders 44 (only one visible) are provided to lift the main body section, each cylinder being pivotally mounted on a pin 45 carried by an ear 46 which extends downwardly from a resptive channel 12 of the truck frame. Two fluid cylinders 47 (only one visible) are provided to lift the loader section 16, each cylinder being pivotally mounted on a pin 48 carried by a respective channel 12. The cylinders 44 and 47 may be connected in any hydraulic system including a valve (not shown) which is located for access by the truck operator.

In FIG. 1, the loader section 16 is in position to receive refuse, and such refuse may be easily tossed through the opening 33 in the tailgate 29 and into the loader section by a refuse collector, since the opening is at a low level at the rear of the truck body.

Figure 2:
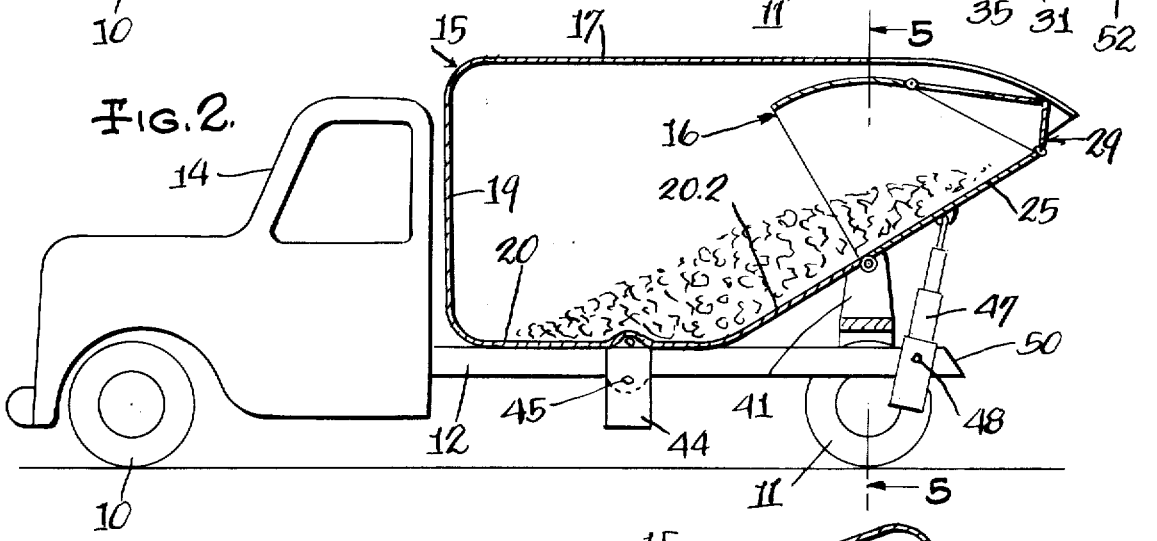
FIG. 2 is a view similar to FIG. 1, but showing the loader section in position for depositing refuse into the main body section.

When the loader section has received sufficient refuse, the truck operator actuates the valve to admit fluid under pressure to the blank end of the cylinders 47 to cause the telescopic sections thereof to extend and swing the loader section 16 about the pivot point 21 to the position shown in FIG. 2. The amount of travel of the loader section may be determined by a limit switch (not shown) or may be judged by the truck operator. In the position shown in FIG. 2, the bottom wall 25 of the loader section 16 is aligned with bottom wall 20.2 of the main section 15 and the inclination of such walls is great enough so that the refuse in the loader section tumbles downwardly into the main body section. Since the body section 15 has considerable volume, the loader section will be moved to and from the position of FIG. 2 a considerable number of times in order to fully load the main body section.

When the main body section is fully loaded, the truck may be driven to a dumping area with the loader section 16 in the position shown in FIG. 2 wherein it at least partially closes the open end of the main body section. However, it is preferred to release the fluid pressure from the blank end of the cylinders 47 so that the loader section 16 returns to its position shown in FIG. 1. In such position the bottom wall 25 bears against the angled ends 50 of the beams 12 and therefore the fluid cylinders 47 are free of any load. Further, the loader section may receive a charge of refuse so that the capacity of the truck body is increased by that amount. Additionally, when the main body section is well loaded, movement of the loader section into the main body section will provide a degree of compaction of the load in the latter. Also, the top wall of the main body section 15 and the wall 27 of the loader section 16 may be omitted to form a top loading dump vehicle, and in this case the section 16 need not be utilized to assist in the loading operation but may be used to assist in unloading operations.

Figure 3:
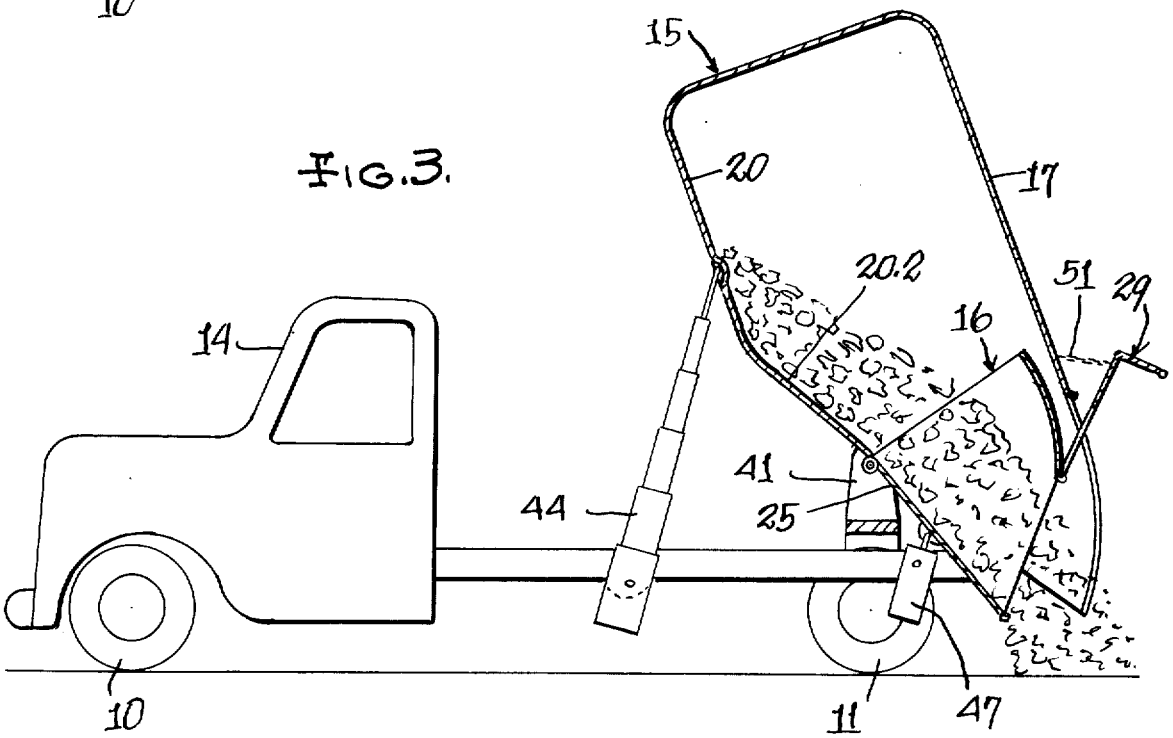
FIG. 3 is a view similar to FIG. 1, but showing the main body section in position for dumping refuse through the loader section and to a dumping area.
Figure 4:
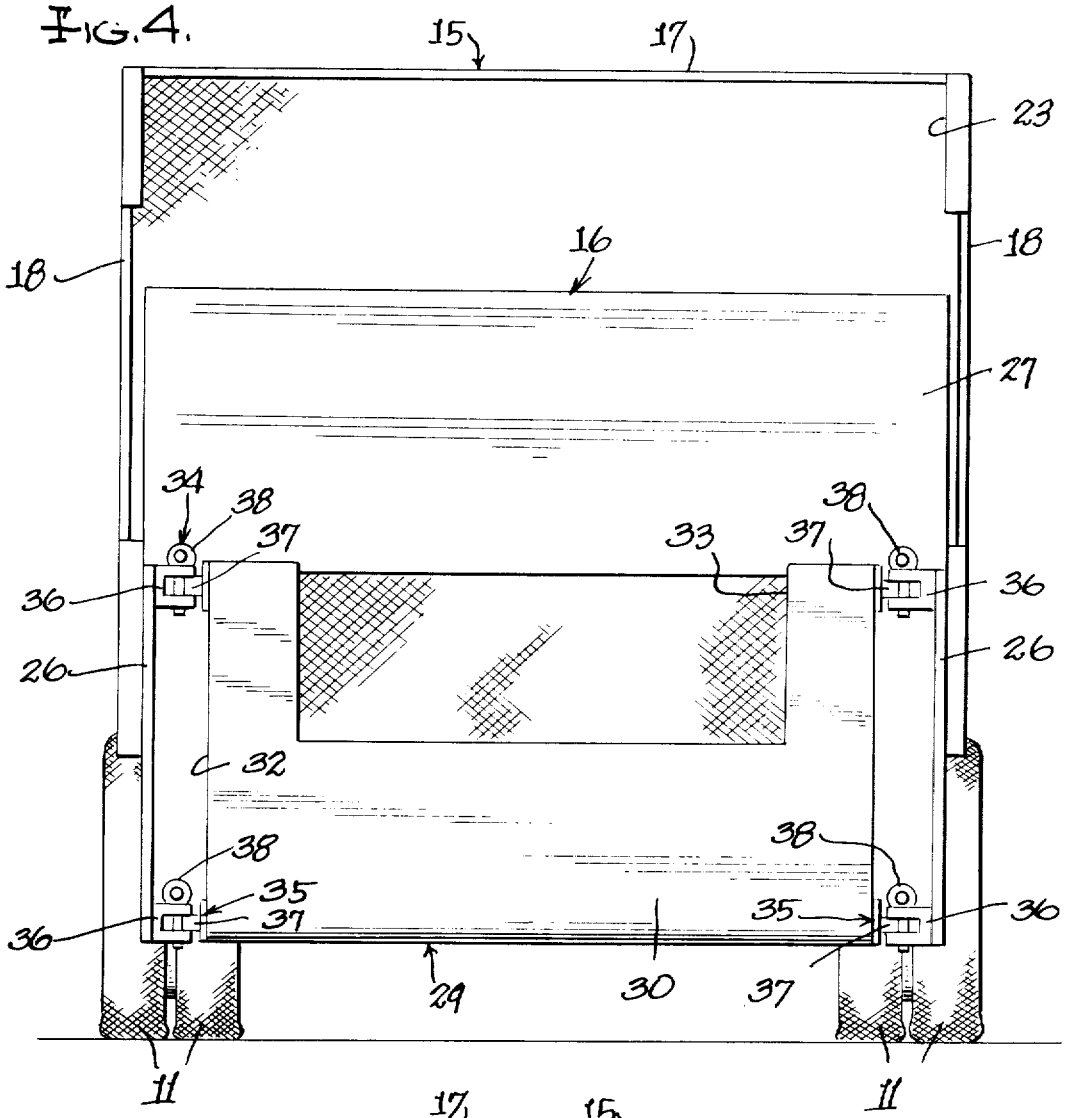
FIG. 4 is an enlarged end view, looking from the right of FIG. 1.
Figure 5:
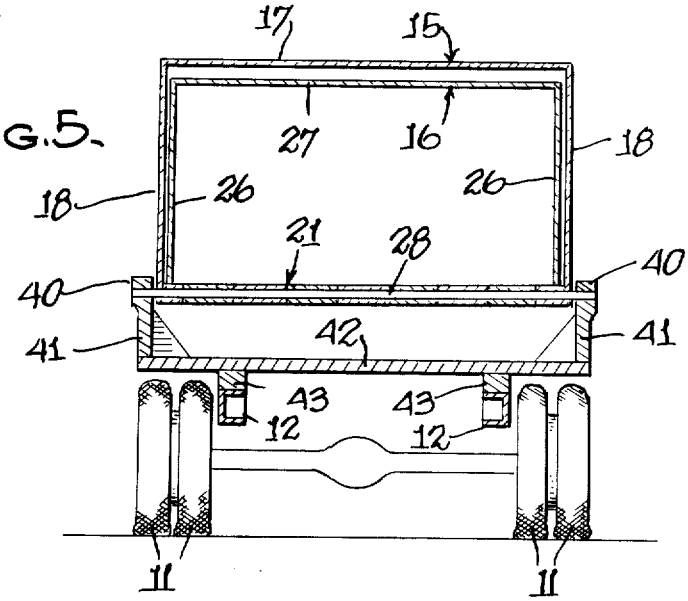
FIG. 5 is a transverse section, corresponding generally to the line 5—5 of FIG. 2.
Figure 6:
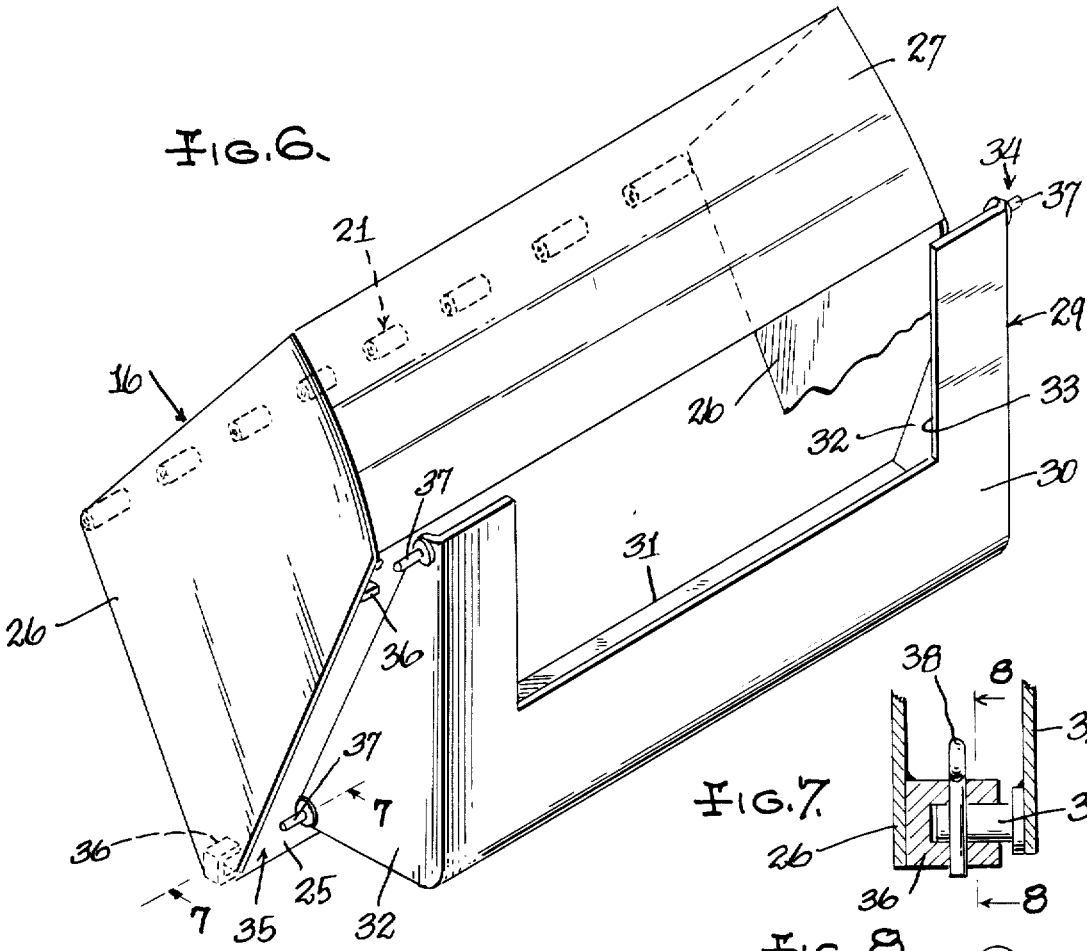
FIG. 6 is an enlarged, fragmentary, separated perspective view, showing the tailgate construction in one position.
Figure 7:
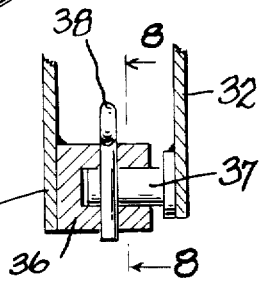
FIG. 7 is an enlarged, fragmentary sectional view corresponding generally to line 7—7 of FIG. 6, but showing parts in assembled relation.
Figure 8:
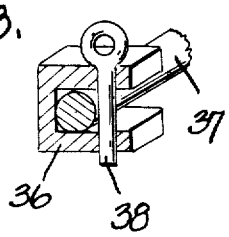
FIG. 8 is a fragmentary sectional view partly in perspective, generally corresponding to the line 8—8 of FIG. 7.

When the truck reaches the dumping area, the pins 38 from the lower hinge connections 35 are removed, and the tailgate is swung to its position shown in FIG. 3, and held in such position by any suitable means, such as a chain connection 51. Fluid under pressure is then admitted to the blank end of the cylinders 44 to extend the telescoped cylinder sections and swing the main body section 15 about the pivot formed by the pintle pin 28 to the position shown in FIG. 3. In such position, the bottom wall 20.2 of the main body section 15 is substantially aligned with the bottom wall 25 of the loader section. The angle of inclination of the walls 20.2 and 25 is great enough so that refuse tumbles from the main body section 15, through the loader section 16, and outwardly of the latter to the dump area. The truck may be moved forward slowly during the dumping operation to evenly distribute the refuse over the dumping area. If the refuse sticks in the main body secction, a slight back and forth jiggling of the truck will dislodge it.

In FIG. 1, the tailgate is shown in dotted lines in the position it would assume when the pins 38 of the tailgate hinge connections 34 are removed. In such position, the tailgate forms a scoop, whereby the truck may be backed toward a pile of aggregates 52 and the latter may be scooped onto the tailgate. The loader section 16 may then be swung to its position shown in FIG. 2 to deliver the scooped aggregates into the main body section. A fluid powered cylinder, hereinafter to be described, may be employed to swing the tailgate so that all the scooped material is deposited into the main body section.

Figure 9:
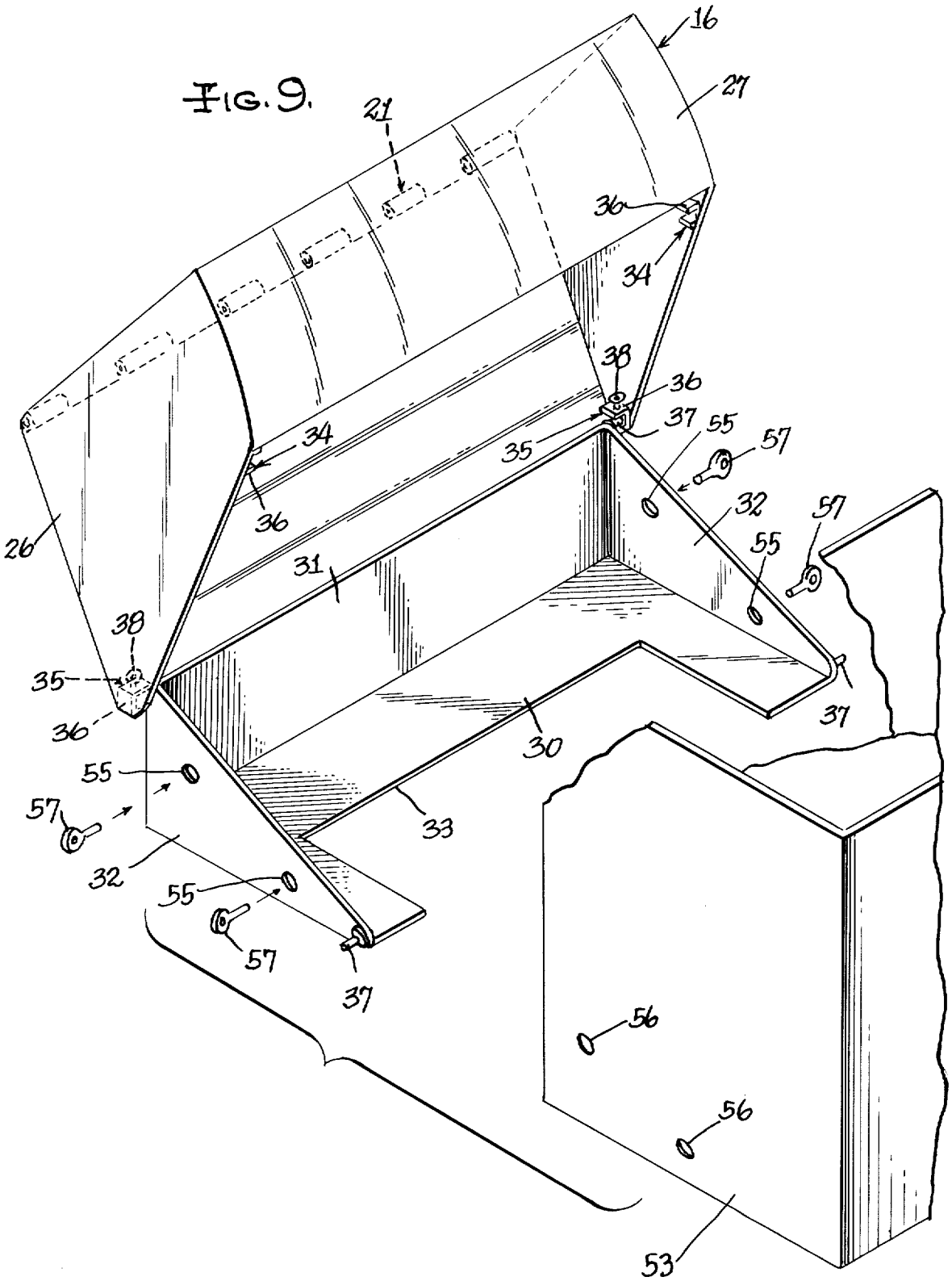
FIG. 9 is a view similar to FIG. 6, but showing the tailgate assembled with the loader section but disposed in another position, and a refuse receptacle in separated relation and fragmentarily shown.

As seen in FIGS. 9 through 12, a refuse container 53 may be deposited on the tailgate when it is in scoop-forming position, that is when the leg portion 30 lies closely along the ground. Such container usually takes the form of a large rectangular box used by commercial establishments to collect refuse until such time as a refuse truck comes along. Many of these containers have wheels or skids to slightly elevate the container bottom, and in such case the horizontally disposed leg portion 30 may be moved under the container bottom, and the container secured to the tailgate in any suitable manner, such as by quick-acting fasteners, chains and the like. In FIG. 9, the side wings 32 of the tailgate are formed with holes 55 which are adapted to generally align with similar holes 56 in the sides of the container 53, and pins 57 are adapted to pass through the aligned holes to secure the container to the tailgate.

Figure 10:
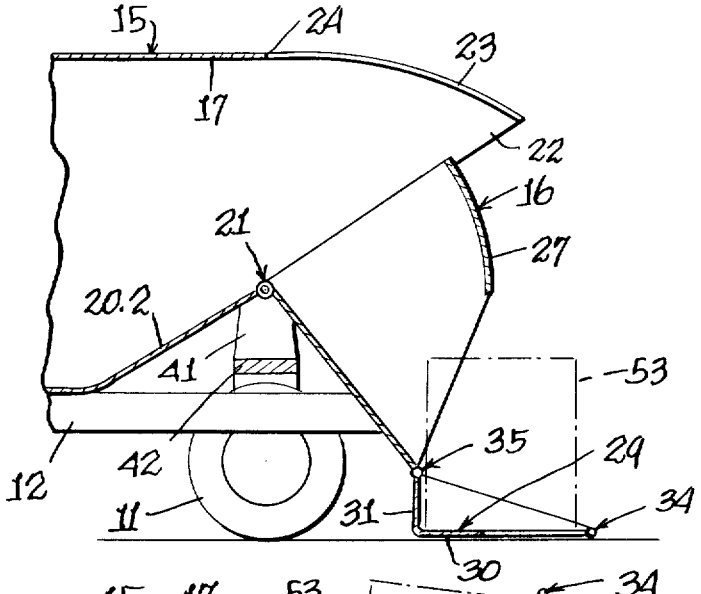
FIGS. 10, 11, and 12 are fragmentary views of a truck showing various steps in the dumping of refuse in a receptable mounted on the tailgate.

FIG. 10 shows the tailgate 29 in its lowered position with the container 53 (shown in dotted lines) resting upon he horizontally disposed leg portion 30 and fixed to the tailgate. The loader section 16 is then swung to the position shown in FIG. 11 by means of the hydraulic cylinders 47 hereinbefore described. In such position, the container 53 is not tilted sufficiently to deposit all of its contents into the main body section. To fully tilt the container, a bumper bracket 60 has one end pivoted at 61 to the pintle pin 28 and is adapted to be swung about such pivot so that it engages the underside of the leg portion 31 of the tailgate and swing the latter to the position shown in FIG. 12, wherein the container 53 is fully tilted to completely deposit all of its contents into the main body section 15. To provide power for swinging the bumper bracket 60, a fluid cylinder 62 has its blank end pivoted at 63 to the undersurface of the wall 25 of the loader section 16, and has the end of its piston rod 64 pivoted to the bracket at 65.

Figure 11:
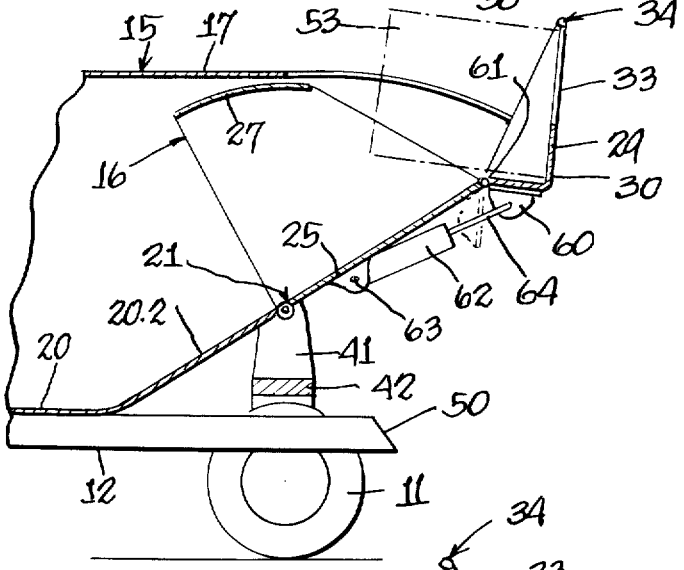
Figure 12:
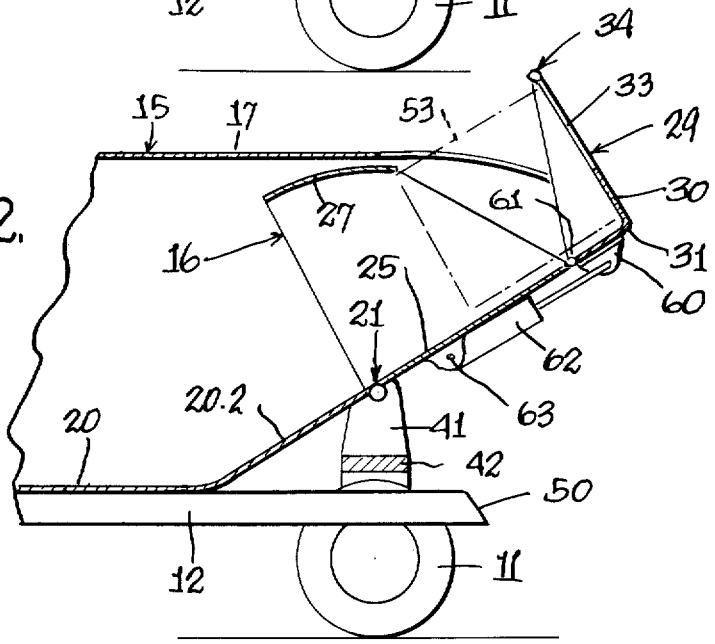

The bracket 60 is shown in dotted lines in FIG. 11 in the position it occupies when it is not operative. When fluid under pressure is admitted to the blank end of the cylinder 62, the piston rod 64 is extended to swing the bracket 60 about its pivot 61 to engagement with the undersurface of the leg portion 31 of the tailgate. Further extension of the piston rod, as seen in FIG. 12, will swing the bracket 60 and the tailgate 29 so that the receptacle 53 is in position to dump all of its contents into the main body section 15.

The structures of the main body section 15 and loader section 16 are shown in the drawings as formed of sheet metal, and it will be appreciated that suitable reinforcing members will be employed, wherever necessary, to provide rigidity.

DESCRIPTION OF OTHER EMBODIMENTS

Figure 13:
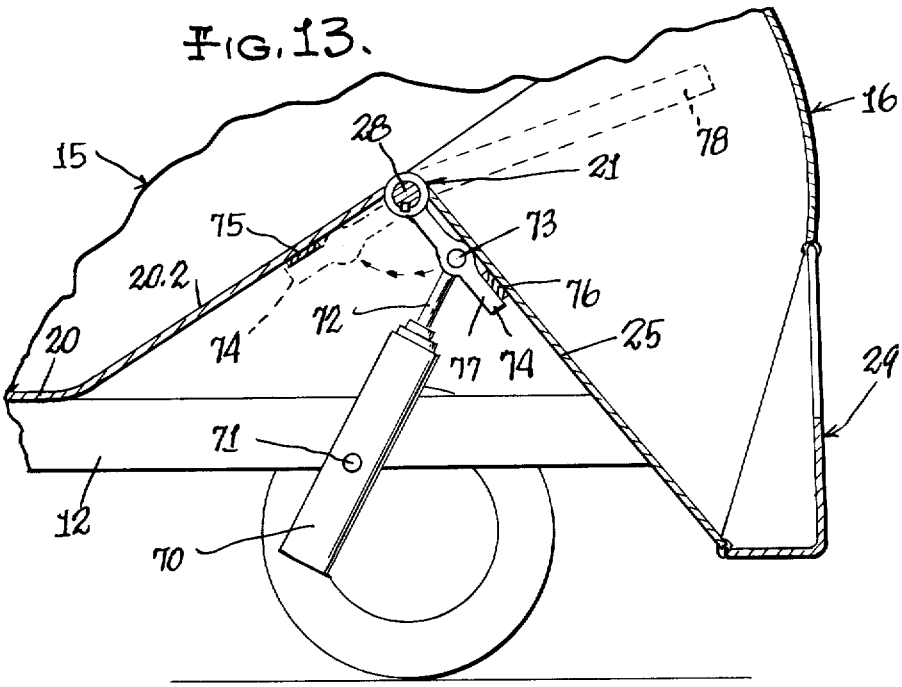
FIG. 13 is an enlarged, fragmentary, longitudinal sectional view showing a modified form of lifting cylinder construction.

The construction shown in FIG. 13 includes the body sections heretofore described and like parts will be designated by like reference numerals. The difference in FIG. 13 is that only one pair of fluid cylinders is used to selectively elevate either the main body section 15 or the loader section 16.

As seen in FIG. 13, the telescopic cylinders 70 (only one shown) are pivoted at 71 to respective frame channels 12. The end of the rod 72 of each cylinder is pivotally connected at 73 to respective flipper arms 74 and each arm is keyed to the pintal pin 28 of the hinge point 21. It will be appreciated that the bottom walls 20.2 and 25 will be suitable reinforced by angle iron structure, and bearing blocks 75 and 76 will be secured to the respective bottom walls to receive the thrust of an end portion 77 of the flipper arms 74.

In the position shown in full lines in FIG. 13, extension of the telescopic cylinders 70 will cause elevation of the loader section 16. In the lowered position of the loader section 16, it will be noted that the piston rod 72 of the cylinders 70 is not fully within the innermost one of the telescoping sections. Secured to an end of the pintle pin 28 outwardly of the body section 15, is a crank 78 which may be manually rotated to swing the flipper arms 74 from the full line position to the dotted line position, and in such latter position, the cylinders 70 are adapted to elevate the main body section 15. Since the piston rod 72 has some travel left inward of the cylinder 70, it moves slightly inward to permit the flipper arm 74 from one position to the other.

Figure 14:
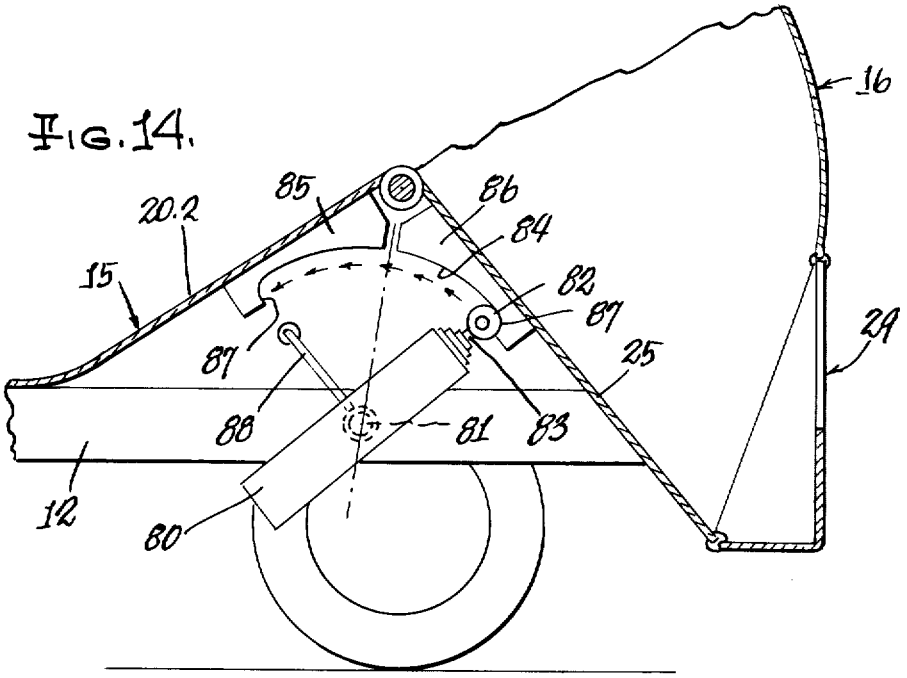
FIG. 14 is a view similar to FIG. 13, but showing another form of lifting cylinder construction.

FIG. 14 discloses an alternate construction wherein only one pair of fluid cylinders is used to selectively elevate either the main body section 15 or the loader section 16. In this construction the aligned telescopic cylinders 80 (only one shown) are pivoted at 81 to the channels 12. A roller 82 is journalled on the outer end of the piston rod 83 and is adapted to ride along a curved track surface 84 which has its center at the pivot point 81. The track surface is formed at the underside of a pair of brackets 85,86, the bracket 85 being secured to the underside of the wall 20.2 of the main body section 15, and the bracket 86 being secured to the undersurface of the wall 25 of the loader section 16. As seen in FIG. 14, the brackets are arranged to provide the track surface 84. Each bracket has an end pocket 87 at the end of its part of the track surface, and the roller 82 is adapted to seat in either one of such end pockets. A crank 88 is provided to swing the cylinders 80 about their pivot 81 so as to deposit the roller 82 in a selected end pocket in position to raise either the main body section 15 or the loader section 16.

Figure 15:
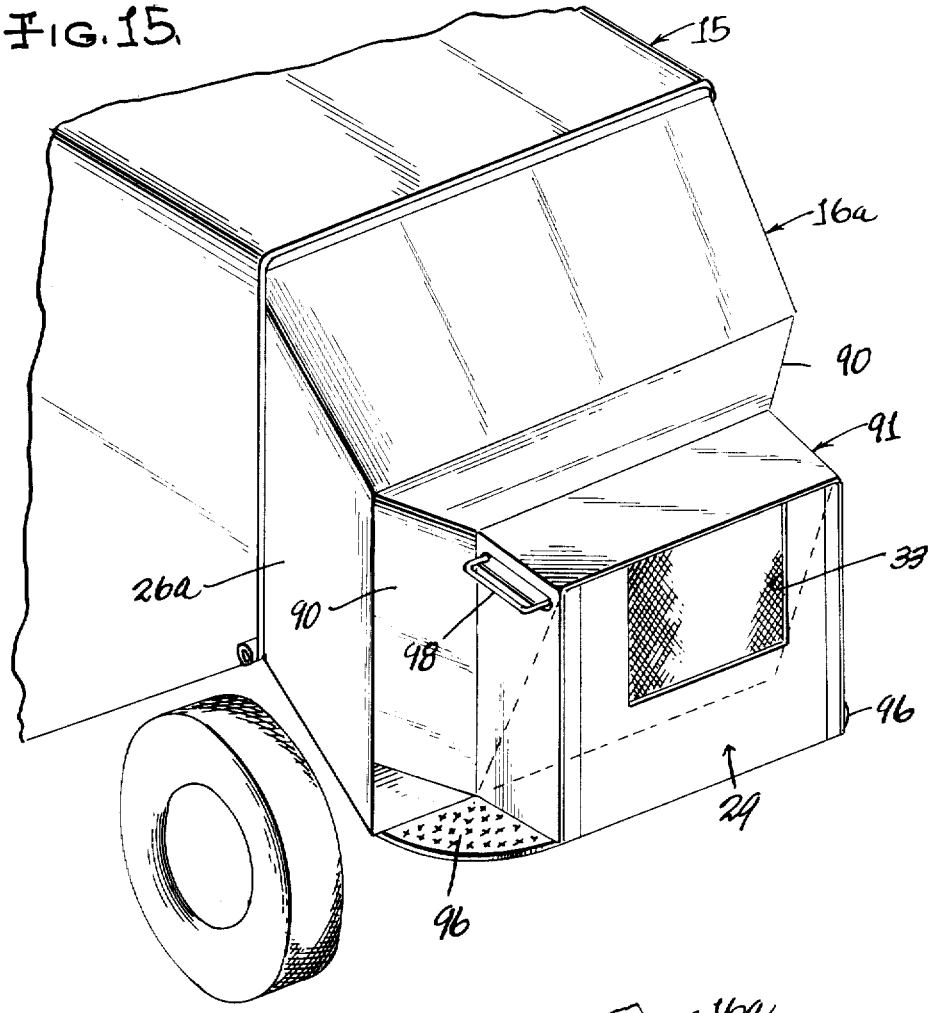
FIG. 15 is a fragmentary perspective view of the rear end of the improved refuse truck, showing modified construction.
Figure 16:
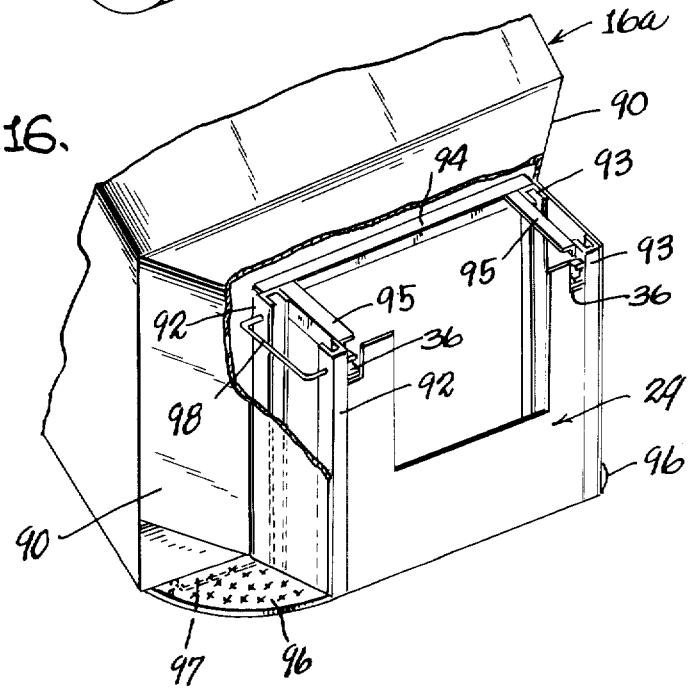
FIG. 16 is a fragmentary perspective view of details of the construction shown in FIG. 15.

In the construction shown in FIGS. 15 and 16, the loader section 16*a* provides a modified version of the section 16 heretofore described, although such section 16*a* is adapted to cooperate with the main body section 15 in all respects as previously detailed.

In FIGS. 15 and 16, the side walls 26*a* are angled inwardly at 90,90 to provide a smaller end box section 91. The box section may be defined by pairs of vertically extending channels 92—92 and 93—93 which are rigidly held in position by cross angle pieces 94 and 95. The sheet metal defining the outer walls of the box section may be riveted, welded or otherwise secured to the channels and angle pieces. The outermost channels 92 and 93 support the clevises 36 of the hinge connections 34,35 for the tailgate 29 and the latter operates in a manner as heretofore described.

A metal step plate 96 is welded to the channels 92—92 and 93—93 at each side of the box section 91 and to an angle piece 97 welded to and extending outwardly from the innermost channels 92,93. The step plates 96 provide a support upon which a workman may stand while the truck is moving. A pair of hand holds 98 (only one visible) are connected to opposite sides of the box section 91 so that a workman standing upon a step plate 96 may grasp a respective hand hold to steady himself.

Figure 17:
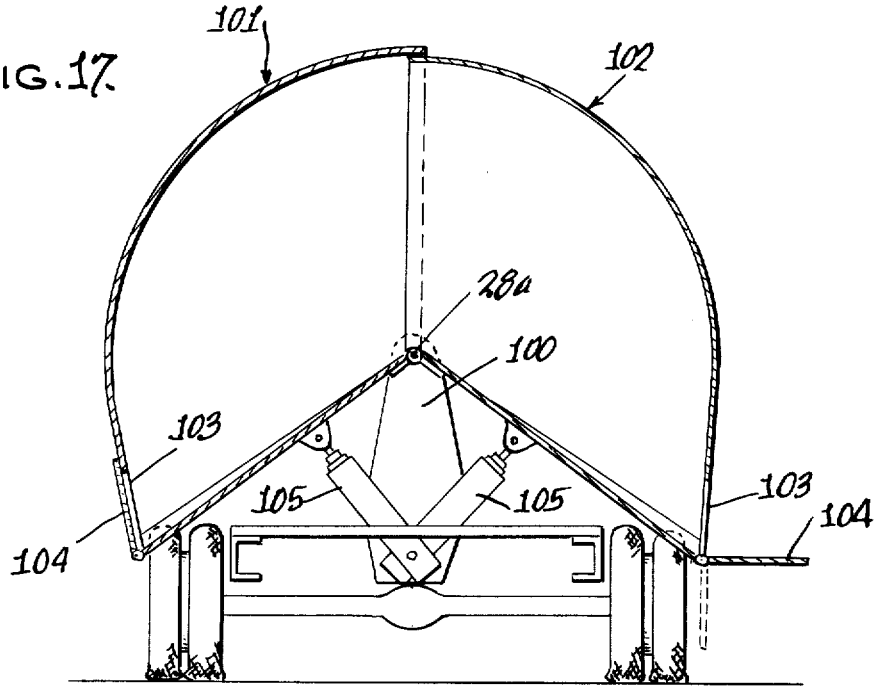
FIG. 17 is a transverse section through an improved refuse truck, showing a modified construction.

In the embodiment of the invention shown in FIG. 17, the pintle pin 28*a* is disposed longitudinally of the truck frame and is supported fore and aft by supports 100 (only one being shown). As herein illustrated the body sections 101 and 102 are elongated longitudinally of the truck frame and are about of equal volume, with the section 102 adapted to swing within the section 101. Each of the sections has a side opening 103 adapted to be closed by what may be termed a side gate 104. In FIG. 17, the right hand gate is shown in full lines as held in a position by a usual chain construction (not shown) so that refuse may be delivered to the side of the truck and deposited into the body section 102 through the opening 103. The section 102 is then swung about the pintle pin 28*a* by fluid cylinders 105 to deposit the refuse from body section 102 into body section 101.

It will be appreciated that refuse may be collected from either side of the truck in the embodiment shown in FIG. 17, since the right hand side gate 104 may be closed and the left hand gate open to pass refuse into the section 101, whereupon fluid cylinder 105 will swing this section to deposit its collected refuse into the section 102. It will also be appreciated that the body may be unloaded from either or both sides, merely by opening the desired side gate 104 and permitting it to fall to the fully open position shown in dotted lines at the right hand side gate.

I claim:

1. A self-loading vehicle having a chassis, the improvement comprising:

a large load-carrying body having a pivot connection between its lower rear portion and said chassis, the axis of the pivot being substantially horizontal and extending crosswise of said chassis at a rear portion thereof, whereby said body may be swung from a normal horizontal position in a vertical direction about said pivot to an upright position, said body having an opening at its rear end, a hopper-type body having side walls and forward and rear walls, a top opening and an opening in its lower rear portion, the upper end of said forward wall being pivotally connected to said pivot whereby said hopper-type body may be swung from a normal upright position in a vertical direction about said pivot to move through said rear end opening of said load-carrying body in inverted relation to deposit its contents into said loading-carrying body, means limiting swinging movement of said hopper-type body in a direction toward its normal upright position to maintain the bottom of such body well above the ground surface along which said chassis moves so that the latter may be freely moved forward and backward without any interference which otherwise might be caused by engagement of the bottom of said hopper-type body with undulations in the ground surface, and a gate for closing said opening in the lower rear portion of said hopper-type body, said gate having a lower wall which provides the bottom of said hopper-type body and such wall having a horizontally disposed pivot connection with the lower end of the forward wall of said hopper-type body, said gate having side walls which form part of the side walls of said hopper-type body and said gate having a rear wall which forms part of the rear wall of said hopper-type body, said gate being swingable about its pivot connection from a normal position substantially closing the rear opening of said hopper-type body to a second position wherein said gate rear wall is disposed close to and substantially parallel to the ground surface so that said gate will act as a scoop when said chassis is moved rearwardly.

2. The construction according to claim 1 wherein the upper end of said gate rear wall has a horizontally disposed pivot connection with the rear wall of said hopper-type body, each of the pivot connections at said gate lower wall and said rear wall being of the latch type wherein either pivot connection may be unlatched to permit swinging movement of said gate bout the latched pivot.

3. The construction according to claim 2 wherein the rear wall of said gate has an opening in an upper portion through which trash and the like may be moved for deposit within said hopper-type body.

4. The construction according to claim 1 wherein the rear wall of said gate in said second position of the latter provides a horizontal support, and an open end trash container of a size less than the size of said gate rear wall and supported thereby and connectable thereto for movement with said hopper-type body when it is moved through the rear end opening of said load-carrying body.

5. The construction according to claim 4 and further including means to swing said gate about its lower wall pivot connection in a direction to tilt said gate sufficiently to allow the contents of said trash container to be emptied into said load-carrying body.

* * * * *